United States Patent [19]

Floyd

[11] Patent Number: 4,949,576

[45] Date of Patent: Aug. 21, 1990

[54] SELF-ADJUSTING LID WRENCH

[76] Inventor: Fred D. Floyd, 1403 Fairview Ave., Monroe, La. 71201

[21] Appl. No.: 375,678

[22] Filed: Jul. 5, 1989

[51] Int. Cl.[5] ..... B67B 7/00

[52] U.S. Cl. ..... 81/3.44; 81/3.42

[58] Field of Search ..... 81/3.42, 3.44, 3.25

[56] References Cited

U.S. PATENT DOCUMENTS

| | | | |
|---|---|---|---|
| 936,035 | 10/1909 | Pratt . | |
| 1,398,125 | 11/1921 | Carleton et al. . | |
| 1,672,311 | 6/1928 | Ermatinger . | |
| 2,002,906 | 5/1935 | Mullan . | |
| 2,458,806 | 1/1949 | Tippett . | |
| 2,507,789 | 5/1950 | Jessup . | |
| 2,541,216 | 2/1951 | Derby . | |
| 2,578,379 | 12/1951 | Taylor | 81/3.44 |
| 2,913,938 | 11/1959 | Yorba | 81/3.44 |
| 2,931,258 | 4/1960 | Ronning | 81/3.44 |

FOREIGN PATENT DOCUMENTS

| | | | |
|---|---|---|---|
| 587004 | 4/1947 | United Kingdom | 81/3.44 |
| 648030 | 12/1950 | United Kingdom | 81/3.44 |

*Primary Examiner*—James G. Smith

*Attorney, Agent, or Firm*—John M. Harrison

[57] ABSTRACT

A self-adjusting lid wrench for removing lids from jars and other containers, which lid wrench is characterized by an elongated channel member having parallel, downwardly-extending flanges for pivotally receiving multiple, spaced, gravity-operated pivoting lugs provided with inwardly-facing lug teeth. A fixed handle is attached to the end of the channel opposite the pivoting lugs and an opening may be provided at the opposite end of the channel adjacent to the lugs, for locating the lid wrench on a nail or other support. A jaw plate is rigidly attached to the channel and the fixed handle and a curved jaw, provided with multiple, spaced jaw teeth which face the lug teeth on the pivoting lugs, is pivotally secured to the jaw plate and receives a jaw handle. Gripping and squeezing of the fixed handle and the jaw handle pivots the curved jaw in a camming action against a jar lid or cap disposed between the jaw teeth and the lug teeth located on a downwardly-oriented, lid-engaging pivoting lug, in order to loosen the lid or cap responsive to counterclockwise twisting of the lid wrench.

21 Claims, 2 Drawing Sheets

SELF-ADJUSTING LID WRENCH

BACKGROUND OF THE INVENTION

Field of the Invention

This invention relates to tools for removing lids and caps from jars and other containers and more particularly, to a self-adjusting lid wrench for accomplishing this function, which lid wrench is characterized by a channel member fitted with multiple, spaced, gravity-operated pivoting lugs having lug teeth on one face thereof. A fixed handle and a flat jaw plate are rigidly attached to one end of the channel opposite the lugs and a curved jaw, fitted with multiple teeth which face the lug teeth located on the pivoting lugs, is pivotally attached to the jaw plate and is fitted with a jaw handle, wherein lightly squeezing the jaw handle toward the fixed handle causes the jaw to pivot in a camming action toward the pivoting lugs, to grip a jar lid or container cap between the jaw teeth and the lug teeth of a downwardly-oriented pivoting lug. The pivoting lugs are so spaced in the channel that jar lids and other container lids and caps of various diameter can be easily fitted between a downwardly-pivoted one of the pivoting lugs and the jaw teeth in self-adjusting fashion and the camming action of the jaw against the lid secures the lid between the jaw teeth and the lug teeth to facilitate loosening the jar lid. A coil spring having one end secured to the jaw plate and the opposite end attached to the curved jaw serves to normally bias the jaw handle away from the fixed handle.

A problem which is well known to everyone is that of loosening tight jar lids and other container caps and lids to remove the contents of the container. The problem is not limited to lids and caps which are compression-sealed on jars and other containers, but also to plastic caps or covers which are sometimes sealed by means of plastic retainers on beverage bottles and other containers. In the case of many beverage bottles, the plastic retainers must first be severed by a knife before the lid can be removed, a practice which is dangerous and time-consuming. Since the lids applied to such containers as pickle jars, for example, are normally smooth and difficult to grip, the lids are frequently difficult to remove with the bare hands, even by one having a strong grip.

Various types of jar-opening aids and mechanisms have been devised and are known in the prior art for removing lids and caps from jars and other containers. A commonly used device is a flexible rubber disk which is placed over the jar lid and gripped by the user to maintain a tight friction fit between the hand and the jar lid, in order to exert sufficient friction to open the lid. Another device is detailed in U.S. Pat. No. 936,035, dated Oct. 5, 1909, to W. A. Pratt, entitled "Wrench". The Pratt wrench is characterized by a pair of generally Z-shaped rods or bars which are pivoted at one end and contain a V-shaped member for engaging a jar or container lid, gripping the lid and exerting sufficient pressure to remove the lid from the container. U.S. Pat. No. 1,398,125, dated Nov. 22, 1921, to W. A. Carleton, et al, details another wrench which includes an elongated handle provided with a pair of jaws thereon, the jaws having jaw teeth for receiving, engaging and removing a jar lid. A "Can Top Remover" is detailed in U.S. Pat. No. 2,002,906, dated May 28, 1935, to J. H. Mullan. The can top remover is characterized by an elongated, slotted plate provided with a set of fixed teeth at the end thereof and a handle pivotally and slidably attached to the fixed member at the slot. The handle is provided with additional jaw teeth for slidably engaging a container lid located between the two sets of teeth, rotating the handle and removing the lid. U.S. Pat. No. 1,672,311, dated June 5, 1928, to P. Ermatinger, details a "Jar Holder" which is characterized by a split-ring provided with a pair of handles and fitted with oppositely-disposed, slotted adjusting members, wherein the fixed ring can be fitted over a jar cap or lid, the adjusting members adjusted on the ring to engage the cap or lid and the handles of the ring squeezed to tighten the ring, secure the adjusting members against the cap or lid and remove the lid. A "Receptacle Cover Pry-Off Tool" is detailed in U.S. Pat. No. 2,458,806, dated Jan. 11, 1949, to J. C. Tippett. The pry-off tool is characterized by a handle provided with a threaded rod and having a pair of oppositely-disposed, concave jaws fitted with jaw teeth, one of which jaws is fixed to the end of the threaded rod and the other threadably adjustable thereon. The lid of a jar or other container is fitted between the two sets of jaws and the threaded jaw is then tightened against the lid to facilitate removal of the lid from the jar or container. U.S. Pat. No. 2,507,789, dated May 16, 1950, to S. E. Jessup, details a "Reciprocating Jaw Jar Wrench" which includes an elongated plate provided with a pair of oppositely-disposed jaws having jaw teeth, both of which jaws are movable on the plate. One of the jaws is fitted with a spring-loaded handle for exerting pressure against a container lid located between the jaws and removing the container lid from the container. U.S. Pat. No. 2,541,216, dated Feb. 13, 1951, to G. T. Derby, details a "Pivoted Jaw Screw Cap Remover". The device includes a flat, elongated, slotted plate provided with a first jaw fixed to the end thereof and a slidably adjustable jaw located intermediate the ends of the plate. The adjustable jaw is adjusted by means of a rod attached thereto to secure the jaws against a lid or cap located therebetween and remove the lid or cap from a container. U.S. Pat. No. 2,578,379, dated Dec. 11, 1951, to S. M. Taylor, details a "Pivoted Jaw Closure Remover with Eccentric Pivot". The device includes a mount plate provided with an adjustable jaw at one end, which jaw is adjustable on the mount plate by means of a peg-and-hole arrangement. An eccentric cam is provided at the opposite end of the mount plate for engaging one side of a jar lid, the opposite side of the lid engaging the adjustable plate for removing the lid from the jar. U.S. Pat. No. 2,931,258, dated April 5, 1960, to J. A. Ronning, Jr., details an "Opener for Screw Caps". The opener is characterized by an elongated base member provided with spaced slots and a downwardly-extending grip portion at one end, with a handle adjustably attached to the elongated member by means of a pin and having a lug which engages a jar or container lid located between the grip portion and the handle lug for removing the lid from the container.

It is an object of this invention to provide a new and improved lid wrench which is characterized by a channel member having a fixed handle at one end, multiple, gravity-operated pivoting lugs fitted to the channel member in spaced relationship and a pivoting jaw and companion jaw handle pivotally attached to the channel member adjacent to the fixed handle, for locating the lid of a container between the pivoting jaw and one of the pivoting lugs in self-adjusting relationship and loosening the lid on the container.

Another object of the invention is to provide a self-adjusting lid wrench which is characterized by an elongated channel member fitted with spaced, aligned pivoting lugs having lug teeth on one face thereof, a fixed handle attached to one end of the channel and a pivoting jaw fitted with jaw teeth and a jaw handle, pivotally secured to the end of the channel adjacent to the fixed handle, wherein squeezing of the two handles rotates the pivoting jaw toward the pivoting lugs and secures a container lid between a downwardly-pivoted one of the pivoting lugs and the pivoting jaw for removal of the container lid from the container.

Another object of this invention is to provide a new and improved lid wrench which is characterized by an elongated channel fitted with downwardly-extending side flanges; multiple, gravity-activated, toothed lugs pivotally disposed in the channel in linearly-spaced, self-adjusting relationship for selective downward extension by gravity from the channel and engagement with one side of a container lid; a fixed handle attached to the channel; and a toothed pivoting jaw and companion jaw handle pivotally attached to the channel in spaced relationship with respect to the fixed handle, for engaging the opposite side of the lid and loosening the lid on the container.

Summary of the Invention

These and other objects of the invention are provided in a new and improved self-adjusting lid wrench for removing lids and caps from jars and other containers, which lid wrench is characterized by an elongated channel member fitted with multiple, aligned, pivoting lugs capable of folding into the channel member and selectively extending from the channel member by operation of gravity, the lugs each containing plate teeth on one side thereof; a fixed handle and a jaw plate rigidly attached to the end of the channel opposite the lugs; a pivoting, spring-biased, toothed jaw pivotally attached to the jaw plate; and a jaw handle rigidly attached to the jaw and spaced from the fixed handle. A container lid may be disposed between the jaw teeth and the lug teeth of a gravity-activated, downwardly-extending lug and gripped by squeezing the handles and urging the jaw handle toward the fixed handle against the spring bias, to grip the lid and remove the lid from the container.

BRIEF DESCRIPTION OF THE DRAWING

The invention will be better understood by reference to the accompanying drawing, wherein.

DESCRIPTION OF THE PREFERRED EMBODIMENT

Figure 1:
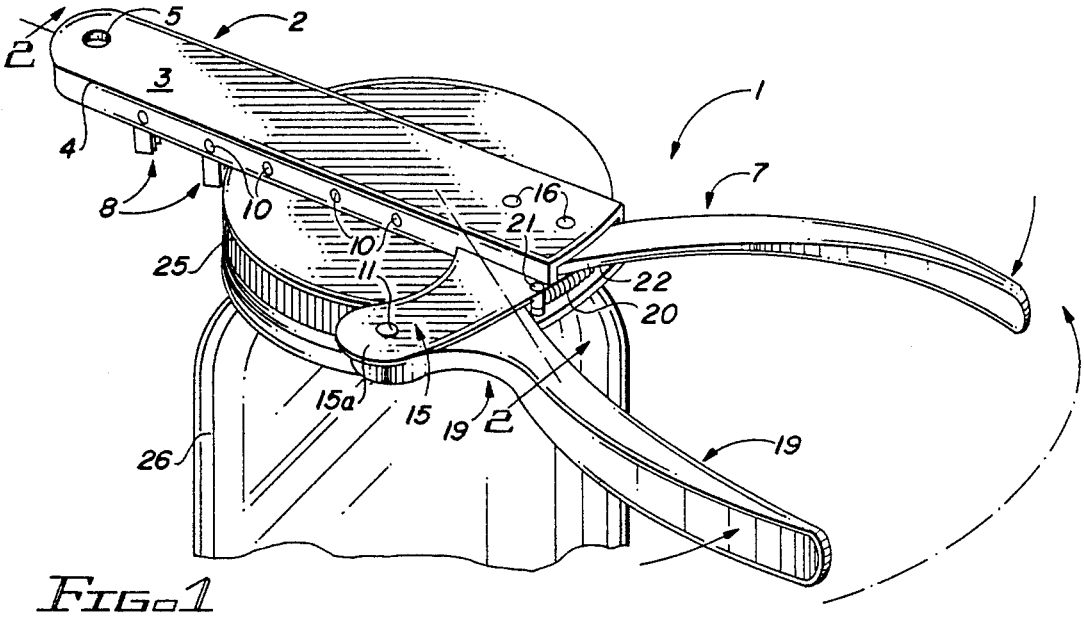
FIG. 1 is a perspective view of a preferred embodiment of the lid wrench of this invention in lid-engaging configuration.
Figure 6:
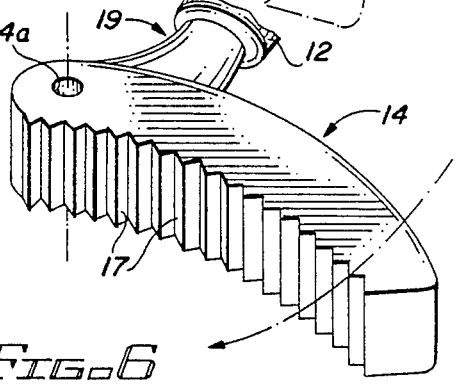
FIG. 6 is a perspective view, partially in section, of the jaw component of the lid wrench.
Figure 7:
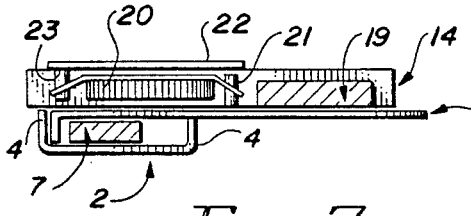
FIG. 7 is a sectional view taken along line 7—7 of the lid wrench illustrated in FIG. 4A.
Figure 8:
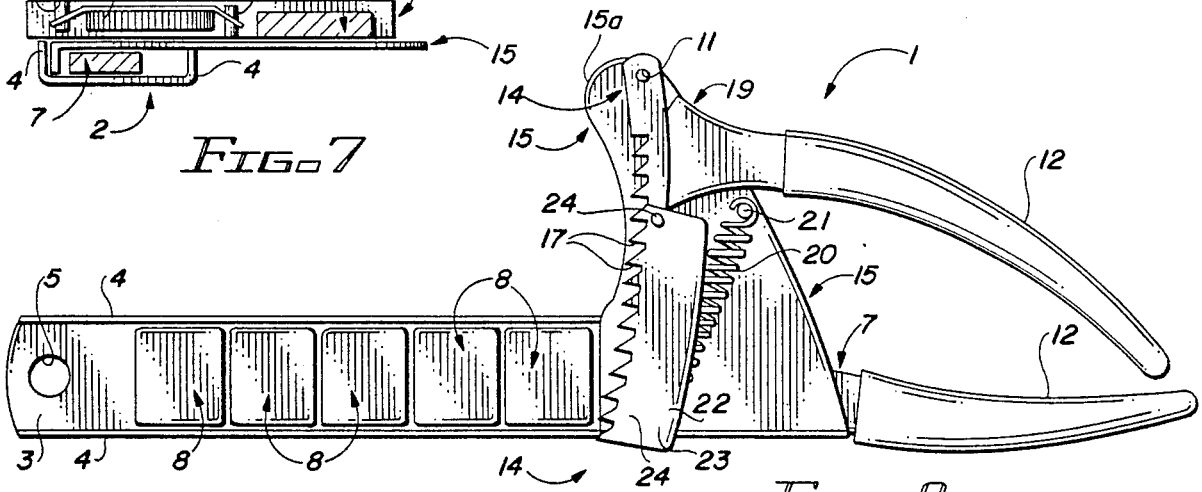
FIG. 8 is a bottom view of the lid wrench with the jaw deployed in engaging configuration, more particularly illustrating the coil spring component for normally biasing the wrench handles apart.

Referring initially to FIGS. 1–4A, 6, 7 and 8 of the drawings, the self-adjusting lid wrench of this invention is generally illustrated by reference numeral 1. The lid wrench 1 is characterized by an elongated channel 2, defined by a flat channel plate 3, having plate flanges 4 extending from the opposite edges thereof in parallel relationship. A plate opening 5 is provided in one end of the channel plate 3 for suspending the lid wrench 1 from a nail, peg or other protrusion (not illustrated), when the lid wrench 1 is not in use. A flat jaw plate 15 is rigidly secured to the opposite end of the channel plate 3 by means of spaced plate mount pins 16 and the jaw plate 15 is shaped to define an extending plate finger 15*a*, which projects from the opposite end of the channel 2 in perpendicular relationship. A fixed handle 7 is also secured to the opposite end of the channel plate 3 of the channel 2 by means of the plate mount pins 16, as illustrated in FIG. 1. One end of a curved jaw 14 is provided with a jaw pin opening 14*a*, as illustrated in FIG. 6, and a handle pivot pin 11 extends through the jaw pin opening 14*a* and through a corresponding opening (not illustrated) in the plate finger 15*a* of the jaw plate 15, to pivotally secure the jaw 14 to the plate finger 15*a*. A jaw handle 19 is fixedly attached to the pivoted end of the jaw 14 by means of spaced guard pins 24, as further illustrated in FIG. 4A. The curved jaw 14 is provided with multiple jaw teeth 17, which extend along the concave edge thereof from the handle pivot pin 11 to the pivoting end of the jaw 14. A spring guard 22 is also mounted on the jaw 14 in spaced relationship with respect to the handle pivot pin 11, by means of the guard pins 24, as further illustrated in FIG. 4A. A coil spring 20 is disposed beneath the spring guard 21, with one end of the coil spring 20 attached to a spring post 21, fixed to the jaw plate 15, and the other end secured to a guard post 23, extending in fixed relationship from the spring guard 22, as illustrated in FIGS. 7 and 8. Optional plastic handle covers 12 may be provided on the fixed plate handle 7 and the jaw plate handle 19, as further illustrated in FIGS. 4A and 8. It will be appreciated that when the jaw handle 19 is depressed toward the fixed handle 7, the jaw 14 pivots on the handle pivot pin 11 from the position illustrated in FIG. 4A toward the plate opening 5 located in the channel plate 3, as illustrated in FIG. 8.

Figure 2:
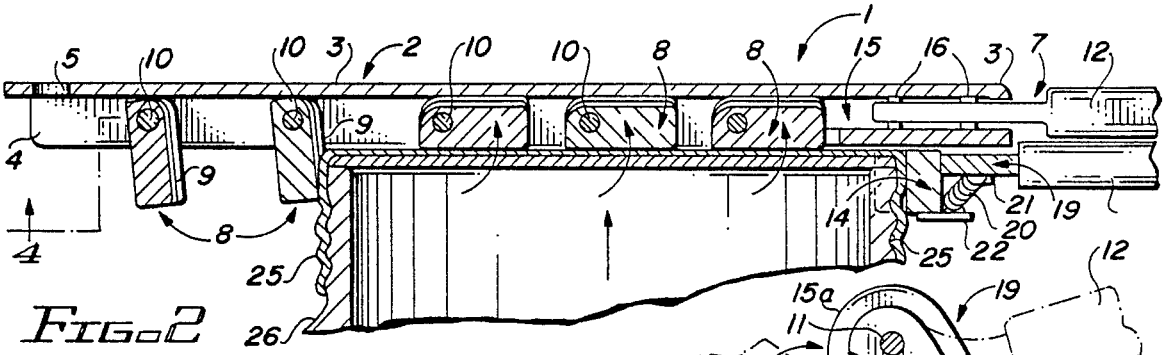
FIG. 2 is a sectional view taken along line 2—2 of the lid wrench illustrated in FIG. 1, with a lid engaged by the lid wrench.
Figure 4:
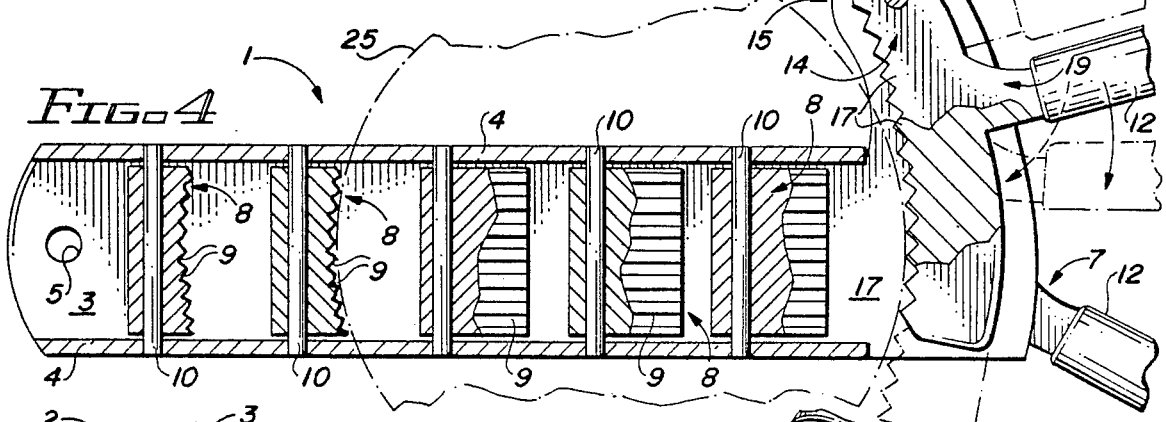
FIG. 4 is a bottom view, partially in section, of the lid wrench illustrated in FIG. 1–3, with the lid engaged by the lid wrench.
Figure 5:
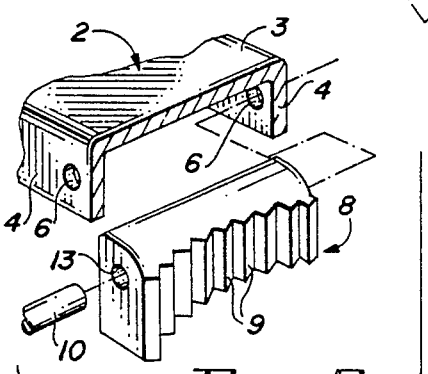
FIG. 5 is an exploded view, partially in section, of a preferred mounting configuration of the pivoting lugs in the channel member of the lid wrench.
Figure 4A:
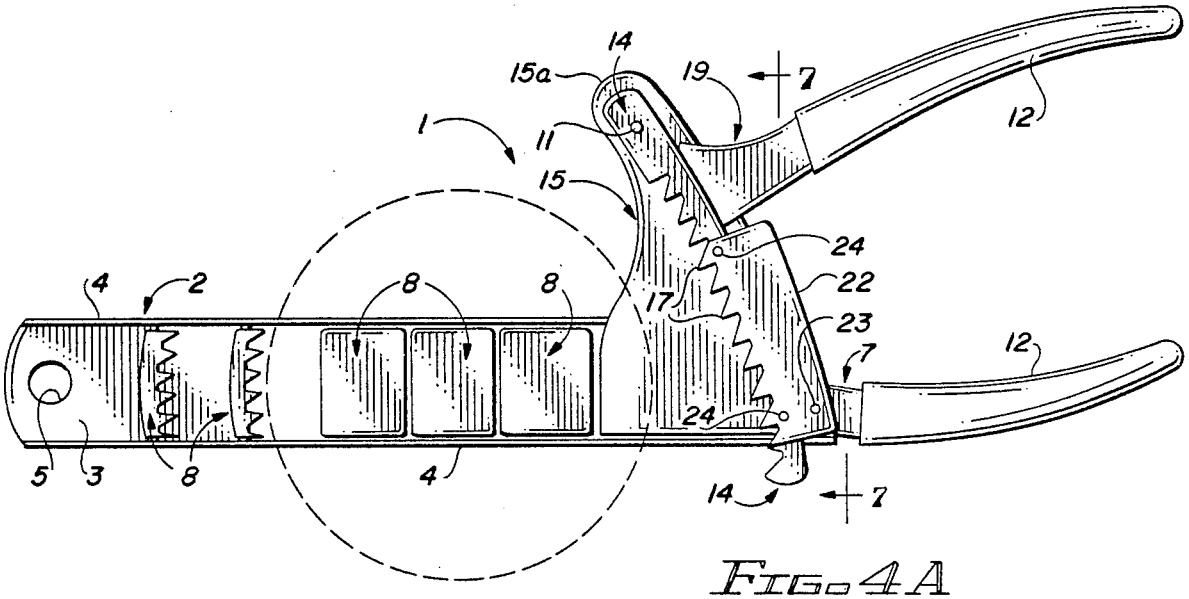
FIG. 4A is a bottom view of the lid wrench illustrated in FIG. 3.
Figure 3:
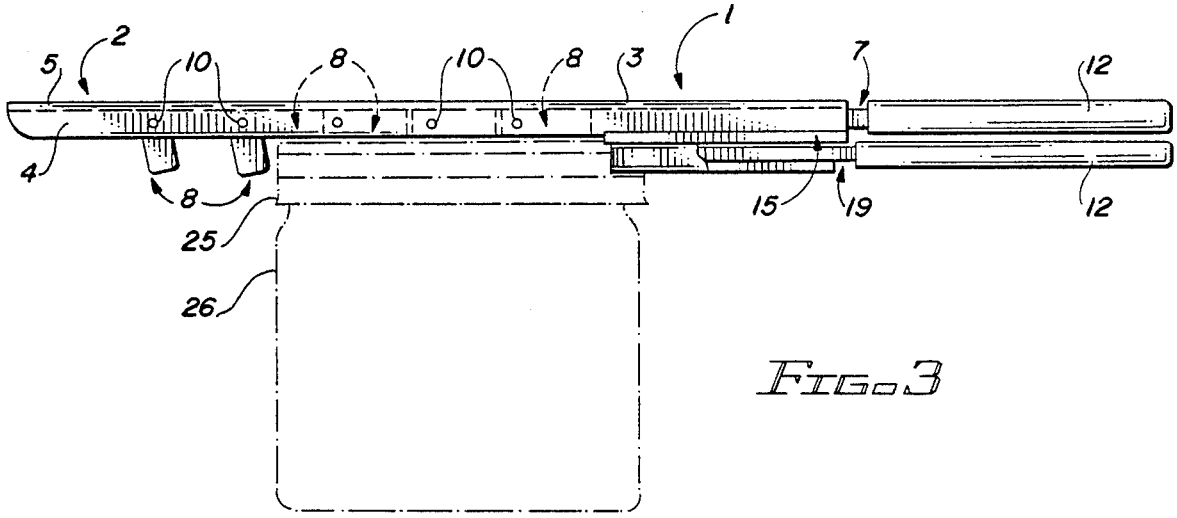
FIG. 3 is a side view of the lid wrench illustrated in FIG. 1, with the lid wrench oriented in engaging configuration.

Referring now to FIGS. 1–4A, 5 and 8 of the drawings, multiple pivoting lugs 8 are pivotally secured in spaced alignment to the parallel plate flanges 4 at one end of the channel plate 3 by means of tooth plate pins 10, which extend through the lug pin openings 13 in the pivoting lugs 8 and are seated in oppositely-disposed flange pin openings 7, provided in the plate flanges 4, respectively, as illustrated in FIG. 5. Each of the pivoting lugs 8 is fitted with multiple plate teeth 9, provided on an engaging surface thereof which faces the jaw teeth 17 in the jaw 14. The pivoting lugs 8 are each designed to pivot into closed configuration in a common plane inside the channel 2, with the plate teeth 9 located adjacent to the channel plate 3 and the pivoting lugs 8 disposed between the plate flanges 4, as illustrated in FIG. 8. In pre-gripping configuration, when the lid wrench 1 is oriented over the lid 25 of a jar 26 with the pivoting lugs 8 facing downwardly, one or more of the pivoting lugs 8 not touching the lid 25 pivots downwardly, as illustrated in FIGS. 1, 3 and 4A, by operation of gravity. When the jaw handle 19 is forced toward the fixed handle 7, the lug teeth 9 of the pivoting lug 8 which is closest to the lid 25 then engage one edge of the lid 25, as illustrated in FIGS. 2 and 4, while an opposite edge of the lid 25 is engaged by the jar teeth 17 as the jaw handle 19 approaches the fixed handle 7, thereby rotating the jaw 14 toward the downwardly-oriented pivoting lug 8. The lid 25 is therefore securely gripped between the engaging pivoting lug 8 and the jaw 14 and removal of the lid 25 from the jar 26 is easily accomplished with a counterclockwise twisting motion of the hand, which further tightens the jaw teeth 17 and lug teeth 9 on the lid 25.

In detailed operation, and referring again to the drawings, the lid wrench 1 is initially oriented with the pivoting lugs 8 extended downwardly in outwardly-pivoted configuration from the channel plate 3, by operation of gravity. The lid wrench 1 is then positioned over the lid 25 of a jar 26 and lowered until the lid 25 engages the pivoting lugs 8 and, depending upon the diameter of the lid 25, one or more of the pivoting lugs 8 may be depressed in folded configuration in the channel 2, with one or more of the remaining pivoting lugs 8 retained in a downwardly-extending configuration adjacent to the outer edge of the lid 25, as illustrated in FIGS. 1, 3 and 4A. This action self-adjusts the lid wrench 1 into pre-engaging configuration on the lid 25. The jaw handle 19 and fixed handle 7 are then lightly squeezed to move the jaw handle 19 toward the fixed handle 7 against the bias of the coil spring 20 and force the jaw 14 inwardly toward the downwardly-extending pivoting lug 8 and secure the lid between the lug teeth 9 of the pivoting lug 8 and the jaw teeth 17 of the jaw 14, as illustrated in FIGS. 2 and 4. The lid 25 is then easily loosened on and removed from the jar 26 by a counterclockwise twisting action of the hand.

Referring again to the drawings, it will be appreciated by those skilled in the art that the lid wrench 1 is capable of engaging and loosening a lid 25 of various diameter without adjustment, due to the aligned and spaced arrangement of the pivoting lugs 8 in the channel 2. As illustrated in FIGS. 2 and 5, the top front edge of each of the pivoting lugs 8 is rounded, to facilitate pivoting of the pivoting lugs 8 into and from the channel 52, and the rear edge of each of the pivoting lugs 8 is squared, to prevent pivoting of the pivoting lugs 8 into the channel 52 from the opposite direction. Accordingly, if it is desired to remove a cap or lid 25 having a diameter slightly smaller than the distance between the jaw teeth 17 and the lug teeth 9 of the closest pivoting lug 8 to the jaw 14, the lid wrench 1 is initially positioned over the lid 25 as described above. The lid 25 is then aligned with and inserted in the space between the jaw teeth 17 and the lug teeth 9, and the fixed handle 7 and jaw handle 19 are lightly squeezed to pivot the jaw 14 toward the lid 25, until the lid 25 is secured between the lug teeth 9, which cannot pivot rearwardly due to the squared rear top edges contacting the channel plate 3, and the jaw teeth 17. The lid wrench 1 is then twisted in the counterclockwise direction as the lid wrench 25 is viewed in FIG. 1, to loosen the lid 25 on the jar 26. Under circumstances where the diameter of the lid 25 is larger than the distance between the jaw teeth 17 and the lug teeth 9 of the first, second, third, or fourth pivoting lug 8, one or more of these pivoting lugs 8 are folded in the channel 2 as the lid wrench 1 is positioned over and engages the lid 25 at the jaw 14 as illustrated in FIG. 2, to facilitate adjustably securing the lid 25 between the jaw teeth 17 and the lug teeth 9 of the remaining downwardly-pivoted pivoting lug 8 which is closest to the lid 25. Gripping of the lid 25 is then accomplished by squeezing the fixed handle 7 and jaw handle 19, as described above. It will be further appreciated that only a minimal gripping force is necessary for application to the fixed handle 7 and the jaw handle 19, since the counterclockwise twisting action of the lid wrench 1 serves to tighten the lug teeth 9 and the jaw teeth 17 on the lid 25 and facilitate removal of the lid 25 from the jar 26.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A self-adjusting lid wrench for removing a lid from a container, comprising a lug support, a plurality of lugs arranged in linearly spaced relationship on said lug support and lug teeth provided on said lugs, a fixed handle carried by said lug support in fixed relationship, jaw means pivotally carried by said lug support in spaced relationship with respect to said lug means and a jaw handle carried by said jaw means in fixed relationship, whereby said lugs and said jaw means engage the lid and the lid is loosened on the container responsive to insertion of said lid wrench over the lid between one of said lugs and said jaw means, squeezing said jaw handle toward said fixed handle and twisting said lid wrench in the counterclockwise direction.

2. The self-adjusting lid wrench of claim 1 wherein said jaw means further comprises a jaw having one end pivotally secured to said lug support and further comprising a set of jaw teeth provided on said jaw, said jaw teeth facing said lugs.

3. The self-adjusting lid wrench of claim 1 wherein said lug support is further characterized by an elongated channel having a channel plate and plate flanges extending from said channel plate in spaced, parallel relationship, for receiving said lugs.

4. The self-adjusting lid wrench of claim 3 wherein said jaw means further comprises a curved jaw having one end pivotally secured to said channel plate and further comprising a set of jaw teeth provided on the concave side of said jaw, said jaw teeth facing said lug teeth on said lugs.

5. The self-adjusting lid wrench of claim 1 further comprising bias means having one end secured to said lug support and the opposite end of said bias means attached to said jaw means, for normally biasing said jaw handle in extended relationship with respect to said fixed handle and said jaw in extended relationship with respect to said lugs.

6. The self-adjusting lid wrench of claim 5, wherein said jaw means further comprises a curved jaw having one end pivotally secured to said lug support and further comprising a set of jaw teeth provided on the concave side of said jaw, said jaw teeth facing said lug teeth on said lugs when at least one of said lugs is disposed in said engaging configuration.

7. The self-adjusting lid wrench of claim 6 wherein said lug support is further characterized by an elongated channel having a channel plate and plate flanges extending from said channel plate in spaced, parallel relationship, and further comprising a plurality of plate pins extending transversely through said plate flanges in spaced relationship for receiving said lugs in pivotal relationship.

8. The self-adjusting lid wrench of claim 1 further comprising a jaw plate fixedly carried by said lug support and wherein said fixed handle is fixedly carried by said lug support and said jaw plate and said jaw means is pivotally attached to said jaw plate.

9. The self-adjusting lid wrench of claim 8 wherein said jaw means further comprises a curved jaw having one end pivotally secured to said lug support and said jaw plate further comprising a set of jaw teeth provided on said jaw, said jaw teeth facing said lug teeth on said lugs when at least one of said lugs is disposed in said engaging configuration.

10. The self-adjusting lid wrench of claim 9 wherein said lug support is further characterized by an elongated channel having a channel plate and plate flanges extending from said channel plate in spaced, parallel relationship, and further comprising a plurality of plate pins extending transversely through said plate flanges in spaced relationship for receiving said lugs in pivotal relationship.

11. The self-adjusting lid wrench of claim 10 further comprising bias means having one end secured to said jaw plate and the opposite end of said bias means attached to said jaw for normally biasing said jaw handle in extended relationship with respect to said fixed handle and said jaw in extended relationship with respect to said lugs.

12. The self-adjusting lid wrench of claim 11 wherein said bias means further comprises a coil spring.

13. A self-adjusting lid wrench for loosening a lid form a container, comprising an elongated lug support; a plurality of generally rectangularly-shaped lugs pivotally carried by said lug support in spaced relationship; lug teeth provided on said lugs; a fixed handle carried by one end of said lug support in fixed relationship; a jaw pivotally carried by said one end of said lug support in spaced relationship with respect to said lugs; and a jaw handle carried by said jaw in fixed relationship, whereby one of said lugs and said jaw engage the lid and the lid is loosened on the container responsive to insertion of said lid wrench over the lid with said lid located between said one of said lugs and said jaw, squeezing said jaw handle toward said fixed handle and twisting said lid wrench in the counterclockwise direction.

14. The self-adjusting lid wrench of claim 13 wherein said lug support is further characterized by an elongated channel having a flat channel plate and plate flanges extending from said channel plate in spaced, parallel relationship, and further comprising a plurality of plate pins extending through said plate flanges in spaced, transverse relationship, for pivotally receiving said lugs.

15. The self-adjusting lid wrench of claim 14 further comprising a jaw plate fixedly carried by said plate flanges and wherein said fixed handle is fixedly carried by said elongated channel and said jaw plate and said jaw is pivotally attached to said jaw plate.

16. The self-adjusting lid wrench of claim 15 further comprising bias means having one end secured to said jaw plate and the opposite end of said bias means attached to said jaw for normally biasing said jaw handle in extended relationship with respect to said fixed handle and said jaw in extended relationship with respect to said lugs.

17. The self-adjusting lid wrench of claim 16 wherein said bias means further comprises a coil spring.

18. A self-adjusting lid wrench for loosening a lid from a container, comprising an elongated channel plate and plate flanges extending from the edges of said channel plate in fixed, parallel relationship; a plurality of plate pins extending through said plate flanges in transverse relationship; a plurality of lugs pivotally carried by said plate pins in spaced relationship, wherein said lugs may be selectively disposed between said plate flanges against said channel plate and outwardly of said channel plate; a fixed handle carried by one end of said channel plate in fixed relationship; a curved jaw pivotally carried by said one end of said channel plate in spaced relationship with respect to said lugs; and a jaw handle carried by said curved jaw in fixed relationship, whereby at least one of said lugs is pivoted outwardly of said channel plate and engages the lid when said curved jaw engages the opposite side of the lid and the lid is loosened on the container, responsive to insertion of said lid wrench over the lid with said lid located between said one of said lugs and said curved jaw, squeezing said jaw handle toward said fixed handle and twisting said lid wrench in the counterclockwise direction.

19. The self-adjusting wrench of claim 18 further comprising a jaw plate fixedly carried by said plate flanges and wherein said fixed handle is fixedly carried by said elongated channel plate and said jaw plate and said jaw is pivotally attached to said jaw plate.

20. The self-adjusting wrench of claim 19 further comprising bias means having one end secured to said jaw plate and the opposite end of said bias means attached to said jaw for normally biasing said jaw handle in extended relationship with respect to said fixed handle and said jaw in extended relationship with respect to said lugs.

21. The self-adjusting wrench of claim 20 wherein said bias means further comprises a coil spring.

* * * * *